US007604504B2

(12) United States Patent
Cheng

(10) Patent No.: US 7,604,504 B2
(45) Date of Patent: Oct. 20, 2009

(54) ELECTRICAL CARD CONNECTOR HAVING GROUNDING PLATE

(75) Inventor: Yung-Chang Cheng, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 21 days.

(21) Appl. No.: 12/077,115

(22) Filed: Mar. 17, 2008

(65) Prior Publication Data

US 2008/0233775 A1 Sep. 25, 2008

(30) Foreign Application Priority Data

Mar. 19, 2007 (TW) ..... 96204331 U

(51) Int. Cl.
*H01R 13/648* (2006.01)

(52) U.S. Cl. ..... 439/607.33

(58) Field of Classification Search ..... 439/607.33, 439/607.22, 607.32, 607.55, 541.5
See application file for complete search history.

(56) References Cited

U.S. PATENT DOCUMENTS 5,967,803 A * 10/1999 Ho ..... 439/79
6,238,240 B1 * 5/2001 Yu ..... 439/541.5
6,354,876 B1 * 3/2002 Yu ..... 439/607.22
7,108,545 B2 * 9/2006 Ting ..... 439/541.5

* cited by examiner

*Primary Examiner*—Phuong K Dinh
(74) *Attorney, Agent, or Firm*—Andrew C. Cheng; Wei Te Chung; Ming Chieh Chang

(57) ABSTRACT

An electrical card connector (100) for receiving a card, comprises an insulating housing (1) defining a card receiving space, a plurality of terminals (5) received in the insulating housing, a shield plate (2) mounted on the insulative housing, a box member (3) mounted on housing and encircling the terminals and a grounding plate (4) sandwiched by the insulating housing and shield plate and retained to the box member.

2 Claims, 4 Drawing Sheets

ELECTRICAL CARD CONNECTOR HAVING GROUNDING PLATE

BACKGROUND OF THE INVENTION

1. Field of the Invention

The present invention generally relates to an electrical card connector, and more particularly to an electrical card connector having a grounding plate.

2. Description of Prior Art

Modern times, the PC card is always used as an external equipment for increase the storage of the electrical consumer products, like Mobile phone, Digital camera, etc. The electrical card connector is used for electrically connecting the PC card and the electrical consumer products, and always comprises a grounding plate cover the parts of the terminals beyond the housing for stopping the Electro-Magnetic Interference. Usually, the housing forms a protuberance, and the grounding plate defines a hole mating with the protuberance for retaining with the card connector. However, this retaining structure between the grounding plate and the housing is not steady after the card repetitiously inserted into the card connector.

Hence, it is desirable to have an improved card connector to overcome the above-mentioned disadvantages of the prior art.

BRIEF SUMMARY OF THE INVENTION

Accordingly, the object of the present invention is to provide an electrical card connector having a grounding plate, which is steadily retained with the electrical card connector.

In order to achieve the above-mentioned object, an electrical card connector for receiving a card, comprises an insulating housing defining a card receiving space, a plurality of terminals received in the insulating housing, a shield plate mounted on the insulating housing, a box member mounted on housing and encircling the terminals and a grounding plate sandwiched by the insulating housing and the shield plate, and retained to the box member.

Other objects, advantages and novel features of the invention will become more apparent from the following detailed description of the present embodiment when taken in conjunction with the accompanying drawings.

DETAILED DESCRIPTION OF THE INVENTION

Figure 1:
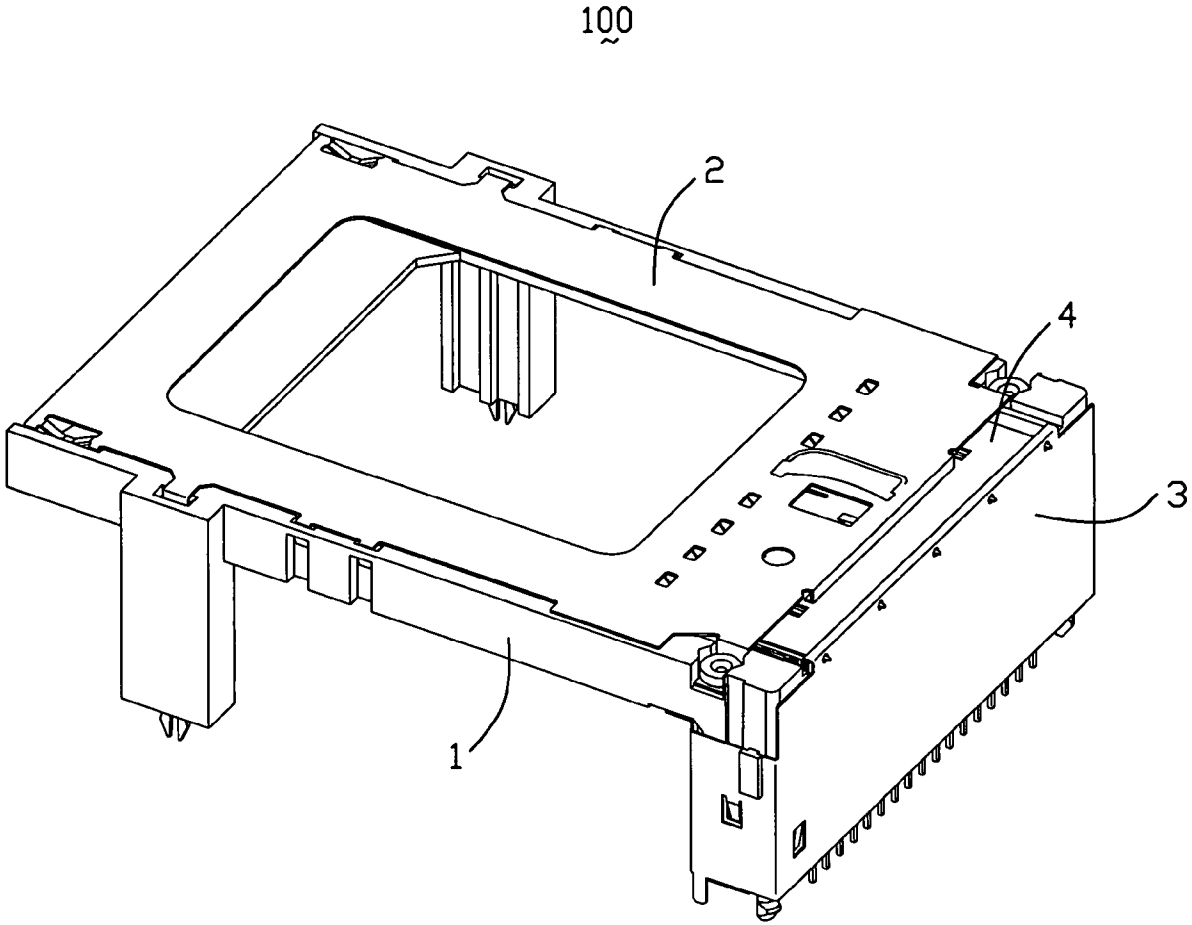
FIG. 1 is a perspective view of an electrical card connector in accordance with the present invention.

Reference will now be made to the drawing figures to describe the present invention in detail.

Referring to FIG. 1 to FIG. 4, a stand-off electrical card connector 100 for receiving a card, comprises an insulating housing 1, a plurality of terminals 5 received in the insulating housing 1, a shield plate 2 assembled on the insulating housing 1, a grounding plate 4 sandwiched by the shield plate 2 and the housing 1, a spacer 6 assembled on the terminals 2, and a metallic box member 3.

Figure 2:
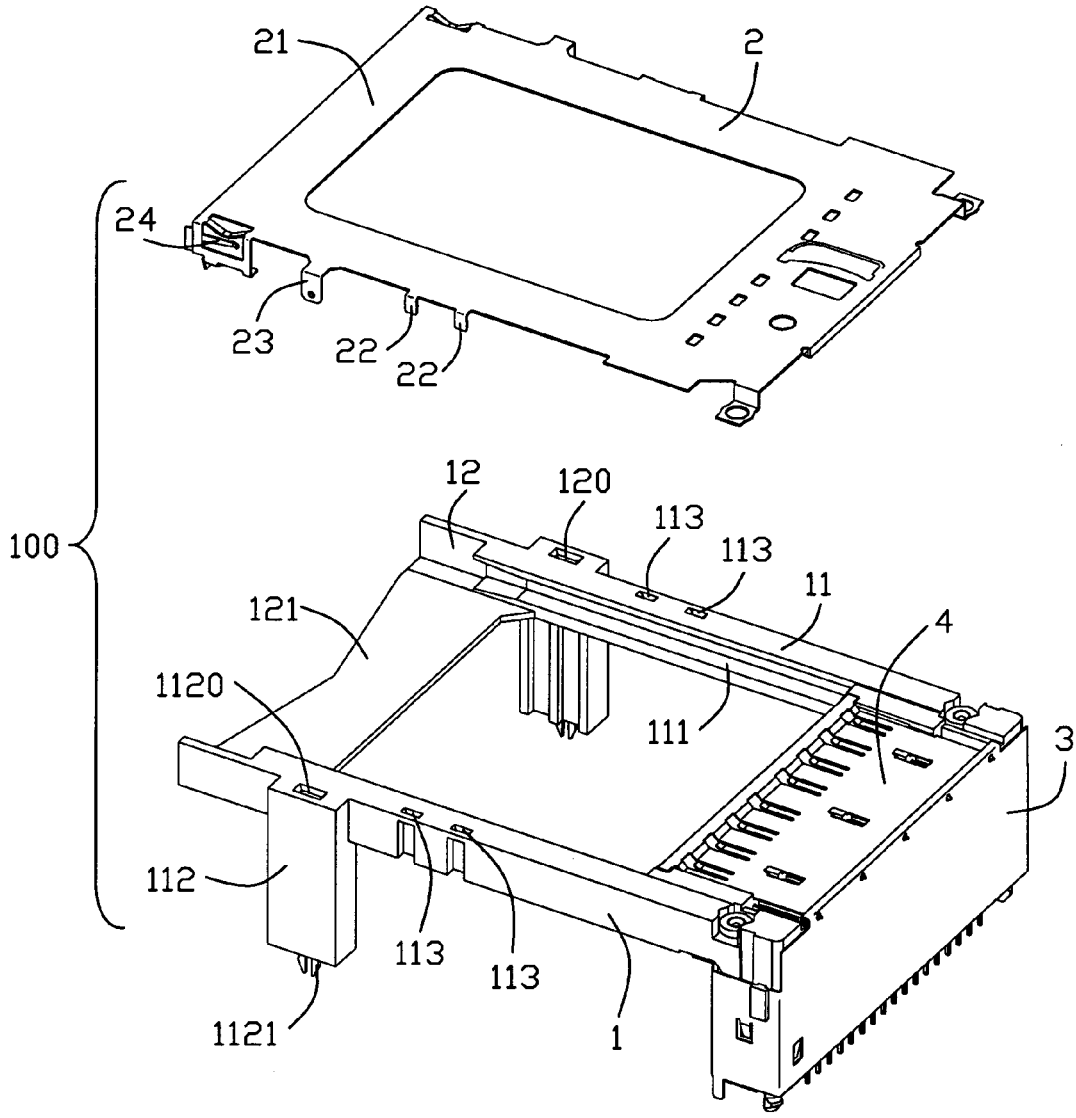
FIG. 2 is a perspective view of the card connector shown in FIG. 1 with a shield plate removed.
Figure 3:
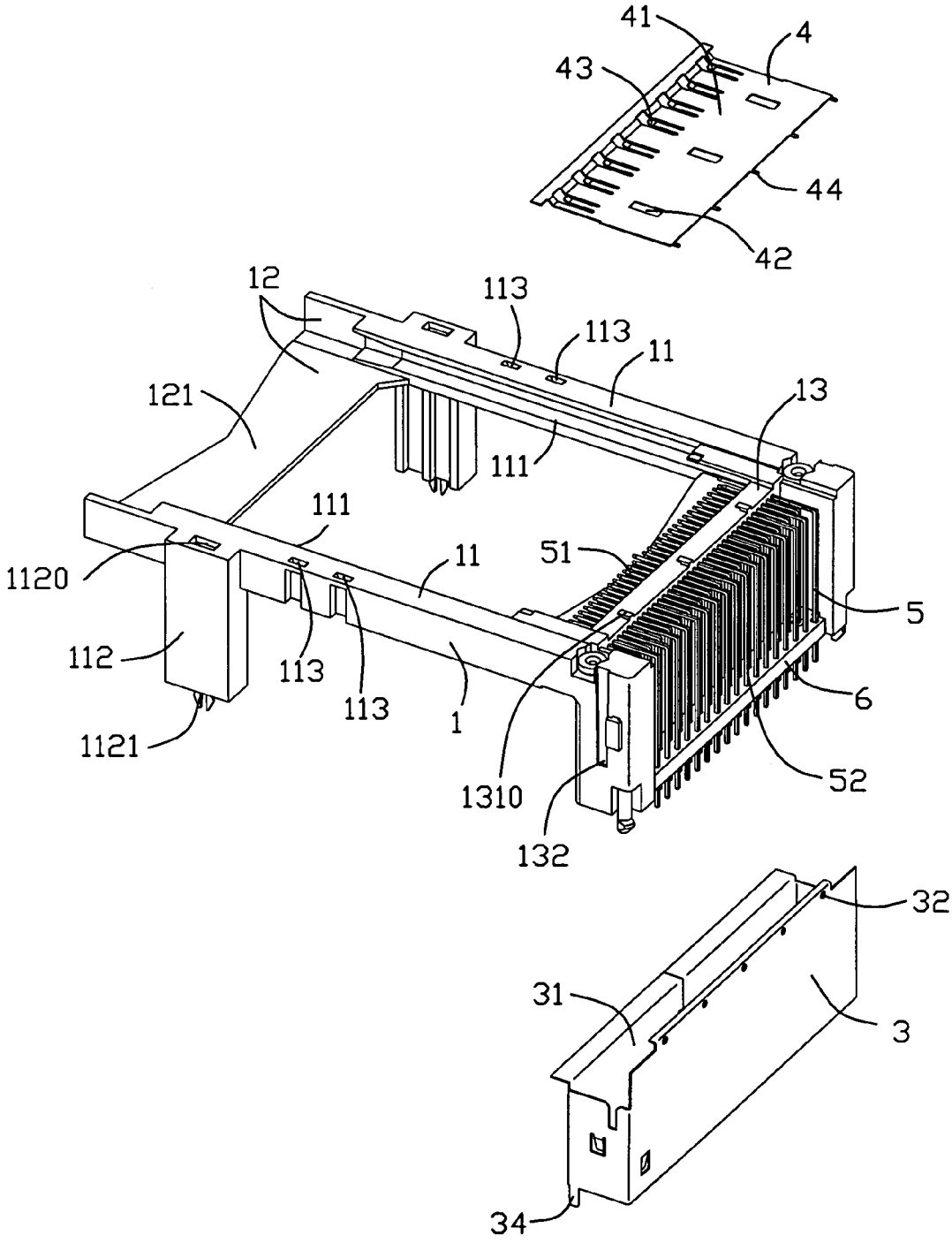
FIG. 3 is an exploded, perspective view of the card connector.

With respect to FIG. 1 and FIG. 2, the insulating housing 1 is configured of a frame with two opposite lateral sides constructed by two beams 11 and a card receiving space between the two beams 11. The two beams 11 together defines a card inserting opening 12 and an engaging portion 13 opposite to the card inserting opening 12, and each beam 11 further comprises two supporting legs 112, 132 arranged along a card inserting direction, and a guiding slot 111 extending along the card inserting direction and communicating with the receiving opening for guiding a card inserting. The engaging portion 13 forms a plurality of blocks 1310 thereon. The first supporting legs 112 are formed adjacent to the card inserting opening, and the second supporting legs 132 are formed adjacent to the engaging portion 13. Each first supporting leg 112 comprises a cutout 1120 at the top end thereof and a locking bar 1121 at the bottom end thereof for positioning on a motherboard or something like this. The pair of second supporting leg 132, respectively, defines a depressing cutout 1320 face to each other. A connecting portion 121 is formed adjacent to the card inserting opening connecting the two beams 11. Moreover, each beam 11 defines a plurality of holes 113 extending therethrought in a vertical direction.

The shield plate 2 comprises a main body 21, a pair of resilient arms 24 correspondingly located in the card inserting opening 12 of the insulating housing 1, a plurality of retaining tabs 22 correspondingly received in the holes 113 of the insulating housing 1, and a pair of mating pieces correspondingly inserted into the cutouts 1120 of the insulating housing 1.

Each terminal 5 comprises a retaining portion (not labeled) retained in the engaging portion 13 of the insulating housing, a contacting portion 51 extending from the retaining portion into the card receiving space, and a tail portion 52 extending downwardly from the retaining portion and sandwiched by the second supporting legs 13.

Figure 4:
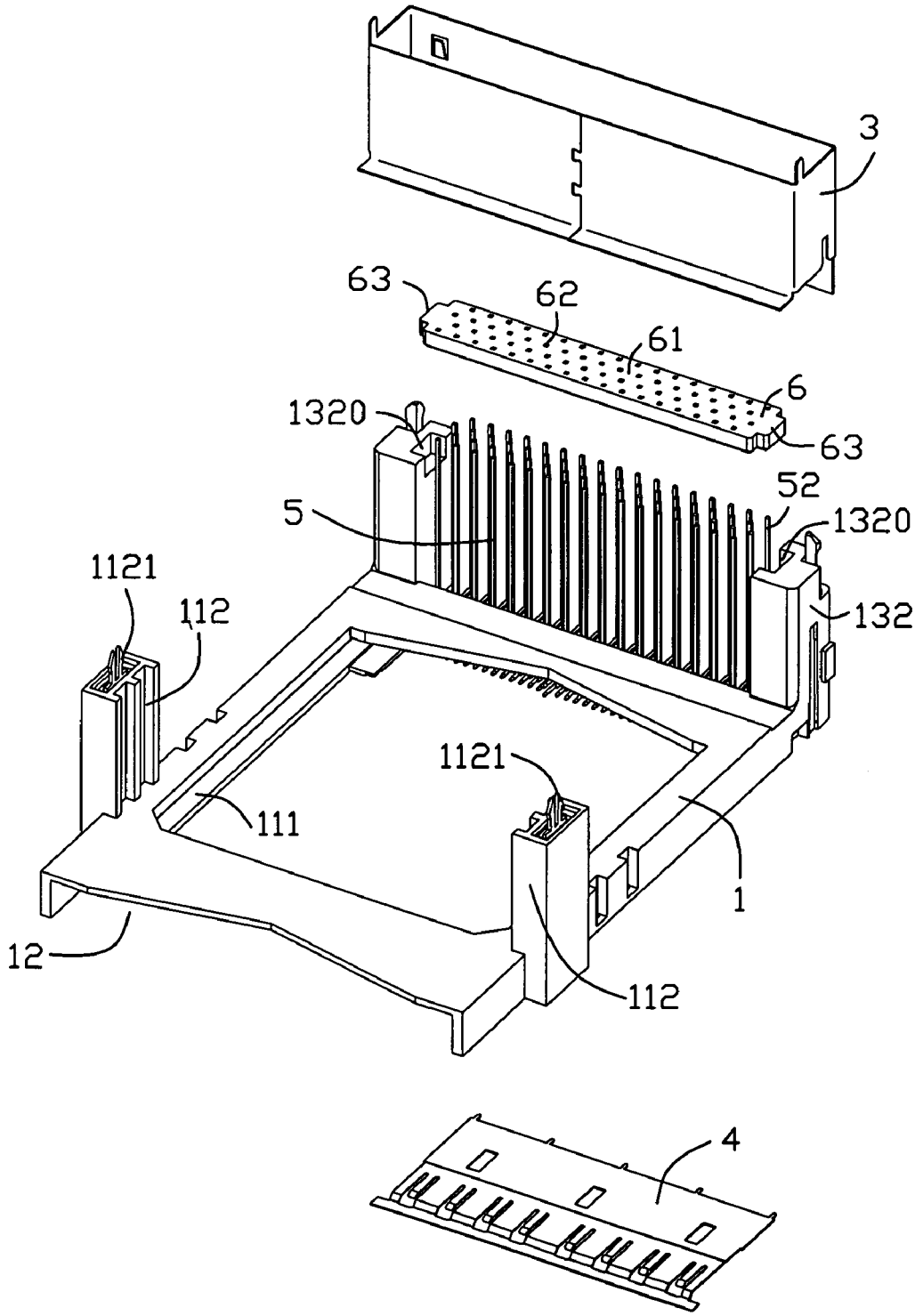
FIG. 4 is an exploded, perspective view of the card connector but taken from another view.

Turning to FIG. 4, the longitudinal spacer 6 comprises a tabulate body 61 having a plurality of pinpricks 62 thereron, and a pair of restricting protuberances 63 formed at the opposite ends of the tabulate body 61. The tail portions 52 of the terminals 5 extend through corresponding pinpricks 62. Meanwhile, the restricting protuberances project into corresponding depressing cutouts 1320 of the second supporting legs 132. The depressing cutouts 1320 restrict the spacer moving in upward direction and transverse direction.

The box member 3 encircling the second supporting legs 132 and the tail portions 52 of the terminals 5, is approximately configured of a box without the top and bottom face, and comprises a pair of grounding tails 34 extending downwardly for electrically connecting with motherboard, a vertical wall (not labeled) extending upwardly. The vertical wall defines a plurality of mounting pores 32.

The grounding plate 4 comprises a base portion 41, a plurality of pins 44 extending from the base portion 41, a plurality of pressing piece 43 arranged in a transverse direction on the base portion 41 to press the card, and a plurality of locking cutouts 42 arranged in the transverse direction on the base portion 41. The grounding plate 4 is placed between the insulating housing 1 and the shield plate 2 with the locking cutouts 42 mating with corresponding blocks 1310 of the insulating housing 1 and the pins 44 retained to the corresponding pores 32 of the box member 3. The base portion 41 covers the contacting portions 51 of the terminals 5. Moreover, in present embodiment, the pins 44 are soldered to corresponding pores 32 of the box member 3. Thereby, the grounding plate 4 is firmly retained on the electrical card connector 100.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical card connector for receiving a card, comprising:

an insulating housing defining a card receiving space;

a plurality of terminals received in the insulating housing, each terminal comprising a tail portion extending out of the insulating housing;

a shield plate mounted on the insulating housing and defining a card inserting opening;

a box conductive member mounted on the housing and encircling the tail portions of the terminals; and a grounding plate sandwiched by the insulating housing and the shield plate and retained to the conductive box member wherein the grounding plate is soldered to the conductive box member, wherein the conductive box member defines a plurality of pores, and the grounding plate comprises a plurality of pins soldered to corresponding pores of the conductive box member, wherein the insulating housing comprises a pair of first supporting legs and a pair of second supporting legs extending downwardly from the opposite sides of the insulating housing, wherein the first supporting legs are located adjacent to the card inserting opening and further comprising a spacer located between the second supporting legs and mating with the tail portions of the terminals, wherein the conductive box member is mounted on the second supporting legs, wherein the grounding plate forms a plurality of pressing pieces in a transverse direction for resisting an inserted card, wherein the conductive box member comprises a pair of grounding tails extending downwardly therefrom.

2. A stand-off electrical card connector for mounting on a motherboard, comprising:

an insulating housing defining a card receiving space and comprising a plurality of supporting legs for increasing the height of the card connector;

a plurality of terminals received in the insulating housing, each terminal comprising a tail portion extending downwardly from the insulating housing and a contacting portion extending into the card receiving space;

a shield plate mounted on the insulating housing; and a grounding assembly, comprising a box conductive member vertically mounted on the insulating housing and encircling the tail portions of the terminals; and a grounding plate connecting with the box member and horizontally extending into the card receiving space covering the contacting portions of the terminals, wherein the tail portions of the terminals are surrounded by a pair of supporting legs of the plurality of supporting legs, wherein the conductive box member is mounted on the pair of supporting legs, wherein the grounding plate is soldered on the conductive box member, wherein the conductive box member forms a grounding pin for electrically connecting with corresponding grounding circuit, wherein the conductive box member defines a plurality of pores, and the grounding plate comprises a plurality of pins soldered to corresponding pores of the conductive box member.

* * * * *